US006845793B2

(12) United States Patent
Rüffer et al.

(10) Patent No.: US 6,845,793 B2
(45) Date of Patent: Jan. 25, 2005

(54) SYSTEM FOR FILLING A PRESSURE MEDIUM ACCUMULATOR

(75) Inventors: Manfred Rüffer, Sulzbach (DE); Andreas Klein, Bad Homburg (DE); Christian Albrich von Albrichsfeld, Darmstadt (DE)

(73) Assignee: Continental Teves AG & Co., oHG, Frankfurt (DE)

( * ) Notice: Subject to any disclaimer, the term of this patent is extended or adjusted under 35 U.S.C. 154(b) by 0 days.

(21) Appl. No.: 10/398,965

(22) PCT Filed: Oct. 9, 2001

(86) PCT No.: PCT/EP01/11679

§ 371 (c)(1),
(2), (4) Date: Apr. 11, 2003

(87) PCT Pub. No.: WO02/31362

PCT Pub. Date: Apr. 18, 2002

(65) Prior Publication Data

US 2004/0020552 A1 Feb. 5, 2004

(30) Foreign Application Priority Data

Oct. 11, 2000 (DE) ..... 100 50 505
Aug. 14, 2001 (DE) ..... 101 39 811

(51) Int. Cl.[7] ..... B21F 27/02
(52) U.S. Cl. ..... 141/7; 141/46; 138/30
(58) Field of Search ..... 147/7, 114, 46, 147/47; 138/30, 31, 26

(56) References Cited

U.S. PATENT DOCUMENTS 2,561,957 A 7/1951 Teague
4,186,777 A * 2/1980 Klope et al. ..... 138/31
4,526,205 A * 7/1985 Sugimura et al. ..... 138/30
4,997,009 A * 3/1991 Niikura et al. ..... 138/30
5,060,703 A 10/1991 Koerner
5,242,384 A * 9/1993 Robinson et al. ..... 604/6.11
5,803,137 A * 9/1998 Shimotoyodome et al. ... 141/67
6,478,051 B1 * 11/2002 Drumm et al. ..... 138/30
2003/0191376 A1 * 10/2003 Samuels et al.

FOREIGN PATENT DOCUMENTS

| | | |
|---|---|---|
| DE | 19852628 | 5/2000 |
| DE | 10053579 | 5/2002 |
| EP | 0391320 | 10/1990 |
| EP | 0980981 | 2/2000 |
| WO | 0031420 | 6/2000 |

OTHER PUBLICATIONS

Patent Abstracts of Japan, Publication No. 2001082401, Publication Date Mar. 27, 2001, Applicant: NOK Corp., Inventor: Mizoshita Shingo, Title: Liquid Filling Method of Pressure Vessel.
Search Report of the German Patent Office for Appln 101398115.

* cited by examiner

*Primary Examiner*—David J. Walczak
*Assistant Examiner*—Khoa Huynth
(74) *Attorney, Agent, or Firm*—Honigman Miller Schwartz and Cohn LLP

(57) ABSTRACT

A method of filling a pressure medium accumulator with a housing having an inner space that is subdivided into two chambers by a metallic pleated bellows used as a media-separating element. The first chamber thereof is filled with a gas and the second chamber is filled with a liquid pressure medium. The bottom valve is provided in a hydraulic port, its closing member being operable by the media-separating element. The valve permits filling of the second chamber with fluid and prevents a complete evacuation of the second chamber. To enable reliable filling of the above-mentioned chambers with corresponding media without damaging the pleated bellows, the method includes the steps of evacuating the second chamber, filling the second chamber with pressure medium and filling the first chamber with a gas.

11 Claims, 1 Drawing Sheet

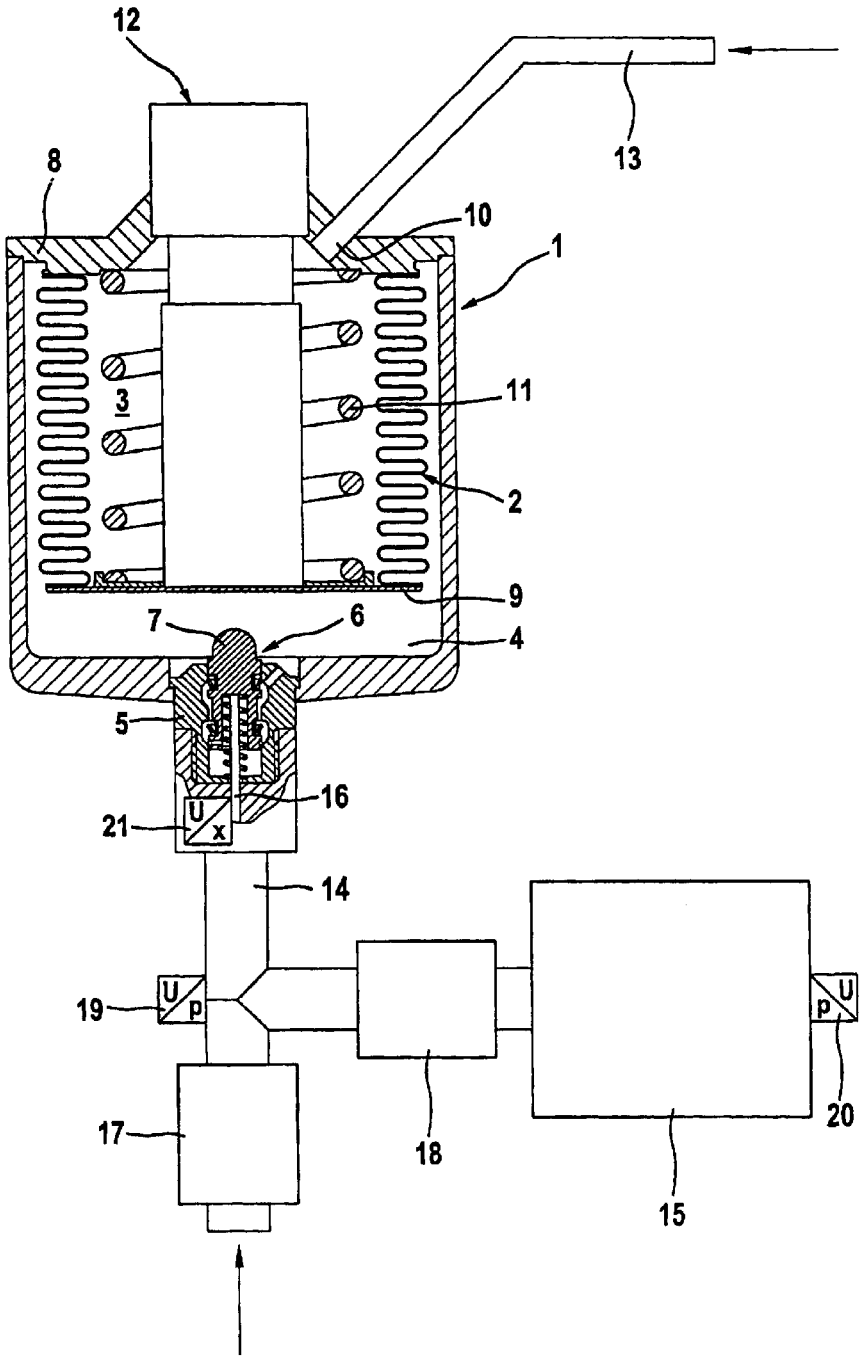
12
13
8
10
1
3
11
2
9
7
6
4
5
16
21
U
x
14
19
U
p
U
p
20
17
18
15

SYSTEM FOR FILLING A PRESSURE MEDIUM ACCUMULATOR

TECHNICAL FIELD

The present invention generally relates to a system for filling a pressure medium accumulator and more particularly relates to a method of filling a pressure medium accumulator with a housing having an inner space that is subdivided into two chambers by a metallic pleated bellows used as a media-separating element.

BACKGROUND OF THE INVENTION

International patent application WO 00/31420 discloses a pressure medium accumulator of this general type. Movement of the pleated bellows causes the closing member of the bottom valve to adopt a position where it carries out the function of a hydraulic piston. The reliability of operation is considerably enhanced because this arrangement reliably prevents damage to the bottom valve and an inadvertent escape of pressure medium. However, the above-mentioned publication does not provide any way for reliably filling the chambers referred to above without damaging the pleated bellows.

BRIEF SUMMARY OF THE INVENTION

Therefore, an object of the present invention is to disclose a method as well as a device for filling a pressure medium accumulator of the above-mentioned type, ensuring that the pleated bellows is permanently in a pressure-balanced condition.

According to the present invention, this object is achieved by the combination of the following process steps:

a) evacuation of the second chamber b) filling of the second chamber with pressure medium c) filling the gas into the first chamber.

To render the idea of the invention more precise, arrangements are made for the second chamber to be filled with a defined pressure medium volume that corresponds to the system requirements for a determined temperature, according to which the first chamber is filled with a corresponding, previously calculated gas volume to compensate for the geometrical tolerances.

In a device for implementing the method of the invention, there is provision of means for evacuating the second chamber, means for filling the second chamber with pressure medium, as well as means for filling the gas into the first chamber.

BRIEF DESCRIPTION OF THE DRAWINGS

FIG. 1 shows a schematic view of the above-mentioned device for implementing the invention method.

DETAILED DESCRIPTION OF THE PREFERRED EMBODIMENTS

Now referring to FIG. 1, the pressure medium accumulator that is to be filled according to the invention method has a housing 1 with an interior that is subdivided by a media-separating element 2 into two pressure compartments or chambers 3, 4. The media-separating element 2 is preferably formed by a thin-walled metallic pleated bellows, which is pressure-tightly connected to a cover 8 closing the housing 1, on the one hand, and closed by means of a plate 9, on the other hand. The interior of the pleated bellows 2 forms the first chamber 3 which can be filled with a gas generally under high pressure through a filling connection 10 provided in the cover 8. In the bottom part of the housing 1, a hydraulic port 5 is designed in which a bottom valve 6 is arranged whose closing member 7 projects into the second chamber 4. The bottom valve 6 is preferably designed so that it permits filling of the second chamber 4 with a pressurized liquid pressure medium, e.g. brake fluid, on the one hand, and prevents complete evacuation of the second chamber 4, on the other hand. Besides, the first chamber 3 houses a compression spring 11 which is compressed between the cover 8 and the previously mentioned plate 9 and, thus, biases the pleated bellows 2 in the direction of the bottom valve 6. This ensures that the hydraulic pressure prevailing in the second chamber 4 is always higher than the gas pressure prevailing in the first chamber 3.

Further, a sensor device carrying reference numeral 12 for sensing the movement of the media-separating element 2 is arranged in the first chamber 3 filled with gas. Sensor device 12 which may e.g. be designed as an inductive distance sensor represents an independent assembly that can be mounted into an opening provided in cover 8.

The drawing also shows a schematic view of a device used to fill the pressure medium accumulator described above with corresponding pressure media. The illustrated device is substantially composed of the following components:

a) a first supply line 13 which is connected to the above-mentioned first chamber 3, on the one hand, and to a pressure gas source not shown, on the other hand, b) a second supply line 14 which is connected to the above-mentioned second chamber 4, on the one hand, and either to a pressure medium source not shown or a vacuum source 15, on the other hand, c) a mechanism 16 for mechanically opening or keeping open the bottom valve 6, said mechanism being adapted to be introduced into the previously mentioned hydraulic connection 5, and d) a shut-off valve 17, 18 inserted in the second supply line 14 and respectively associated with the pressure medium source and the vacuum source 15.

It is suitable to arrange for a first pressure sensor 19 to monitor the pressure medium filling pressure, a second pressure sensor 20 for monitoring the level of the vacuum generated by the vacuum source 15, and a distance sensor 21 for monitoring the movement of the mechanism 16 for mechanically opening or keeping open the bottom valve 6.

Before the filling operation commences that will be explained hereinbelow, it shall be assumed that the above-mentioned plate 9 is positioned on a first stop (e.g. on the bottom of housing 1) under the effect of compression spring 11, and that the bottom valve 6 is closed. A signal value of the distance sensor 12 which is determined and stored corresponds to this initial condition. The determined signal value is later used in operation to detect defects at the bottom valve 6. To achieve the same effect in a design without the above-mentioned compression spring 11, low pressure (e.g. compressed air up to 2 bar) is applied to the first chamber 3.

After the device 16 which may e.g. be configured as a metallic pin has opened the bottom valve 6, the second supply line 14 (by way of opening the associated shut-off valve 18) is connected to the vacuum source 15 and the second chamber 4 evacuated. After the evacuation the second chamber 4 is filled completely with a pressure medium provided herefor, preferably brake fluid under low pressure, with the pleated bellows 2 being compressed by a small extent. Subsequently, the compression spring 11 or the gas pressure acting in the first chamber 3 causes a slow outflow of the excess pressure medium volume until the bottom valve 6 closes. Because the closing member 7 of the bottom valve, the plate 9 closing the pleated bellows 2, and the distance sensor 12 are in contact with each other, the signal value of the distance sensor 12, at which the bottom valve 6 closes, may be determined and stored.

A defined pressure medium volume is replenished which corresponds to the system-induced minimum requirements and represents e.g. the volume value that ensures a proper functioning of the pressure medium accumulator at the temperature of 120° C. This causes compression of the pleated bellows 2 or, respectively, a movement of the plate 9 closing it in an upward direction until a defined position to which a third signal value of the distance sensor 12 corresponds. The signal value is again determined and stored.

Subsequently, pressure medium is replenished until the plate 9 reaches a mechanical stop not shown, that is e.g. arranged in the first chamber 3. Again, a signal value of the distance sensor 12 which is determined and stored corresponds to this top position of the (compressed) pleated bellows 2. The mentioned signal value is especially appropriate in preventing destruction of the pleated bellows 2.

After the signal value corresponding to the top position has been acquired, the replenished pressure medium volume is again bled until the position adjusted by replenishment of the defined pressure medium volume has been reached. In this position, the first chamber 3 is filled with a suitable gas by way of the first supply line 13, whereafter the above-mentioned filling connection 10 is closed. Subsequently, the pressure medium that remained in the accumulator is bled until the bottom valve 6 closes. The filling operation is now terminated, and the accumulator with the determined signal values can be delivered.

What is claimed is:

1. Method of filling a pressure medium accumulator, said accumulator including a housing having an inner space that is subdivided into first and second chambers by a metallic pleated bellows used as a media-separating element, the first chamber thereof being filled with a gas and the second chamber being filled with a liquid pressure medium, and wherein a bottom valve is provided in a hydraulic port connected to said second chamber and includes a mechanical mechanism located within said bottom valve for opening or keeping open the bottom valve and a distance sensor located adjacent said mechanical mechanism wherein a closing member of said bottom valve is operable by the media-separating element, wherein said bottom valve permits filling of the second chamber with pressure medium and preventing a complete evacuation of the second chamber, said method comprising the steps of:

a) actuating the bottom valve using the mechanism b) evacuating the second chamber c) filling of the second chamber with said liquid pressure medium d) filling said gas into the first chamber sensing and monitoring the movement of said mechanical mechanism for mechanically opening or keeping open said bottom valve, and measuring the position of the closing member of the bottom valve.

2. Method as claimed in claim 1, further including the steps of:

filing the second chamber with a defined volume of said liquid pressure medium that corresponds to the system requirements for a determined temperature, and filling the first chamber with a corresponding, previously calculated gas volume to compensate for a geometrical tolerance.

3. Method as claimed in claim 2, further including the step of:

sensing a distance covered by the pleated bellows when the second chamber is filled with said defined volume of said liquid pressure medium.

4. Method as claimed in claim 2, further including the step of:

sensing a condition of the bottom valve, and removing said liquid pressure medium from the second chamber in a controlled manner until a closed condition of the bottom valve has been reached.

5. Method as claimed in claim 1, further including the step of:

filling the second chamber with liquid pressure medium until a stop for the pleated bellows is reached, and, sensing the distance covered by the pleated bellows.

6. Method as claimed claim 1, further including the step of:

before the second chamber is filled with pressure medium, moving the pleated bellows into abutment on a second stop, and, sensing the distance covered by the pleated bellows.

7. Method as claimed in claim 6, further including the step of:

moving the pleated bellows into abutment on a second stop by the effect of a pneumatic pressure.

8. A pressure medium accumulator, comprising:

a housing having an inner space that is subdivided into first and second chambers by a metallic pleated bellows used as a media-separating element, the first chamber thereof being filled with a gas and the second chamber being filled with a liquid pressure medium, a bottom valve provided in a hydraulic port which hydraulically communicates with said second chamber, wherein said bottom valve includes a closing member which is operable by a media-separating element, wherein said bottom valve permits filling of the second chamber with pressure medium and preventing a complete evacuation of the second chamber, a mechanical mechanism located within said bottom valve for opening or keeping open said bottom valve, and a distance sensor located adjacent said mechanical mechanism for sensing and monitoring the movement of said mechanical mechanism for mechanically opening or keeping open said bottom valve and for measuring the position of the closing member of the bottom valve means for evacuating the second chamber, means for filling the second chamber with liquid pressure medium while the housing is closed, means for filling the gas into the first chamber.

9. Device as claimed in claim 8, further including a first supply line connected to the first chamber and used for supplying said gas to said first chamber, and a second supply line that is connected to the second chamber and adapted to communicate alternatively with a pressure medium source or a vacuum source.

10. Device as claimed claim 8, further including a pressure sensor for measuring the pressure medium filling pressure that prevails in the second supply line when the second chamber is filled.

11. Device as claimed in claim 8, further including a vacuum sensor for measuring the vacuum produced by the vacuum source during evacuation of the second chamber.

* * * * *

UNITED STATES PATENT AND TRADEMARK OFFICE

CERTIFICATE OF CORRECTION

PATENT NO. : 6,845,793 B2
DATED : January 25, 2005
INVENTOR(S) : Rüffer et al.

It is certified that error appears in the above-identified patent and that said Letters Patent is hereby corrected as shown below:

Column 3,
Line 62, change "filing the second chamber" to -- filling the second chamber --.

Column 4,
Line 18, change "Method as claimed claim" to -- Method as claimed in claim --.

Signed and Sealed this

Twenty-eighth Day of June, 2005

JON W. DUDAS
*Director of the United States Patent and Trademark Office*